US007302207B2

(12) United States Patent
Mercer

(10) Patent No.: US 7,302,207 B2
(45) Date of Patent: Nov. 27, 2007

(54) COVER ADAPTED FOR PROTECTING A PHOTOSENSITIVE MEMBER OF A PROCESS CARTRIDGE

(75) Inventor: Christopher Paul Mercer, Dongara (AU)

(73) Assignee: GCC IP Pty Ltd, Perth (AU)

( * ) Notice: Subject to any disclaimer, the term of this patent is extended or adjusted under 35 U.S.C. 154(b) by 0 days.

(21) Appl. No.: 10/905,972

(22) Filed: Jan. 28, 2005

(65) Prior Publication Data

US 2005/0281582 A1 Dec. 22, 2005

(30) Foreign Application Priority Data

Jun. 18, 2004 (AU) ..... 2004202645

(51) Int. Cl.
*G03G 21/18* (2006.01)
*G03G 15/00* (2006.01)

(52) U.S. Cl. ..... 399/114; 399/159

(58) Field of Classification Search ..... 399/114, 399/116, 159, 26
See application file for complete search history.

(56) References Cited

U.S. PATENT DOCUMENTS

| | | | | |
|---|---|---|---|---|
| 5,277,943 | A * | 1/1994 | Adiletta et al. | 428/375 |
| 5,794,102 | A * | 8/1998 | Coffey et al. | 399/114 |
| 5,937,242 | A * | 8/1999 | Yokoyama et al. | 399/114 |
| 6,144,821 | A * | 11/2000 | Oguma | 399/114 |
| 6,171,369 | B1 * | 1/2001 | Schultink et al. | 95/57 |
| 6,428,610 | B1 * | 8/2002 | Tsai et al. | 96/15 |
| 6,771,916 | B2 * | 8/2004 | Hoffman et al. | 399/92 |

* cited by examiner

*Primary Examiner*—David M. Gray
*Assistant Examiner*—Joseph S. Wong

(57) ABSTRACT

A cover (4) adapted for protecting a photosensitive member (2) of a process cartridge (1), the cover (4) comprising a filter (5) adapted to capture airborne particles from air flowing around or through the cover (4). Preferably, the filter (5) takes the form of a High Efficiency Particulate Air Filter, or "HEPA", which contains micron sized pores for capturing the very smallest airborne particles.

44 Claims, 7 Drawing Sheets

COVER ADAPTED FOR PROTECTING A PHOTOSENSITIVE MEMBER OF A PROCESS CARTRIDGE

FIELD OF THE INVENTION

The invention relates to a cover for a process cartridge for an electrophotographic device. The cover is suitable for use in such devices as laser printers, laser photocopiers and laser facsimile machines, and will be described hereinafter with reference to such applications.

BACKGROUND TO THE INVENTION

Toner cartridges for laser printers, copiers and multi function devices are well known in the art. A typical toner cartridge is designed to be handled by non skilled users during replacement or clearing of paper jams. To protect the photosensitive drum during such handling operations a cover is employed which is normally open when the cartridge is in use and closes when the printer or copier is opened for maintenance. Such drum covers are disclosed in U.S. Pat. No. 4,462,677 and U.S. Pat. No. 4,470,689.

In most popular embodiments of toner cartridges, the drum cover is solid and swings on an arm to a retracted position outside the cartridge. There are exceptions to this architecture, for example, as disclosed in U.S. Pat. No. 5,231,453, where a flexible cover is caused to roll up when retracted; and U.S. Pat. No. 6,091,916 where a multi-plate or slatted cover is caused to retract to a position inside the cartridge casing.

In the more common system where the cover is a one-piece barrier moulded out of styrene or similar material, which when retracted or open swings to a position outside and slightly removed from the cartridge body, it has been found beneficial to utilise the cover to guide airflow around the cartridge. Such systems are disclosed in U.S. Pat. No. 5,878,304, U.S. Pat. No. 6,075,956 and U.S. Pat. No. 6,097,911.

Most printers and copiers are fitted with a fan to move air through the interior of the apparatus and around or through the constituent modules. As far as the toner cartridge is concerned this has the beneficial effect of removing unwanted ozone which is generated at the primary charge station; and also loose particles of paper fibre and toner powder. Commonly, a filter might be fitted inside the main apparatus to capture such waste particles. An example would be a mechanical filter coupled with an active carbon element to remove the particulate matter and reduce the ozone respectively from the ejected air. It has also been proposed in U.S. Pat. No. 4,540,268 to mount the ozone filter onto the toner cartridge itself.

Recently, there has been concern about toner particles entering the office atmosphere.

It is a general object of the present invention to overcome one or more of the disadvantages of the prior art, or at least to provide a useful alternative thereto. However, the invention aims more specifically, at least in its preferred form, to reduce the amount of particles present in the air ejected from the main apparatus.

SUMMARY OF THE INVENTION

Accordingly, in a first aspect the invention provides a cover adapted for protecting a photosensitive member of a process cartridge, the cover comprising a filter adapted to capture airborne particles from air flowing around or through the cover.

Preferably, the filter comprises an outer and an inner layer of fabric. More preferably, the outer and inner layer are formed from the same fabric. The fabric is preferably spun-bond polypropylene, which is a non woven material. In a preferred form, the density of the fabric is 45 grams per square metre for the outer layer and 38 grams per square metre for the inner layer. The outer layer preferably has an air permeability greater than that of the inner layer, and more preferably around 1.5 times that of the inner layer. Preferably, the air permeability of the outer layer is around 1500 mm/s. Preferably, the air permeability of the inner layer is around 1000 mm/s.

It will be appreciated that the filter may take various forms. For example, the filter can be a High Efficiency Particulate Air Filter, or "HEPA", which contains micron sized pores for capturing the very smallest airborne particles.

Preferably, the inner layer is formed from a white coloured fabric to allow for ease of visual detection of an amount of toner captured by the filter.

Preferably, the filter fabric has micro-filtration properties which are chosen to target contamination particles in the airflow within an electrophotographic apparatus. Typically, it is the smaller contamination particles that escape from the system and are borne away by circulating air. Preferably, the equivalent opening size of the outer and inner layers is substantially the same. More preferably, the equivalent opening size is less than around 0.2 mm, and preferably, less than 0.15 mm.

The measurements of air permeability and equivalent opening size referred to above are determined in accordance with Chinese standard Guobiao Tuijian GB/T5453-1997 and GB/T14799-1993.

Preferably, the drum cover comprises a mounting frame engageable with opposite longitudinal ends of a main body of the process cartridge. More preferably, the mounting frame is a wire frame. Preferably, one side of the filter is connected to the main body of the process cartridge and the other side is connected to the mounting frame, such that moving the frame toward the photosensitive member extends the filter over the photosensitive member and moving the frame away from the photosensitive member retracts the filter from the photosensitive member.

According to a second aspect, the invention provides a process cartridge for an electrophotographic device, the cartridge comprising a photosensitive member and a cover adapted for protecting said photosensitive member, the cover comprising a filter adapted to capture airborne particles from air flowing around or through the cover.

Preferably, the filter comprises an outer and an inner layer of fabric. More preferably, the outer and inner layer are formed from the same fabric. The fabric is preferably spunbond polypropylene, which is a non woven material. In a preferred form, the density of the fabric is 45 grams per square metre for the outer layer and 38 grams per square metre for the inner layer. The inner layer preferably has an air permeability greater than that of the outer layer, and more preferably around 1.5 times that of the inner layer. Preferably, the air permeability of the inner layer is around 1500 mm/s. Preferably, the air permeability of the outer layer is around 1000 mm/s.

It will be appreciated that other fabrics can be used for the filter. For example, the filter can be formed from one or more layers of "HEPA", which contains micron sized pores for capturing the very smallest airborne particles.

Preferably, the inner layer is formed from a white coloured fabric to allow for ease of visual detection of an amount of toner captured by the filter.

Preferably, the filter fabric has micro-filtration properties which are chosen to target contamination particles in the airflow within an electrophotographic apparatus. Typically, it is the smaller contamination particles that escape from the system and are borne away by circulating air. Preferably, the equivalent opening size of the outer and inner layers is substantially the same. More preferably, the equivalent opening size is less than around 0.2 mm, and preferably, less than 0.15 mm.

The measurements of air permeability and equivalent opening size referred to above are determined in accordance with GB/T5453-1997 and GB/T14799-1993.

Preferably, the drum cover comprises a mounting frame engageable with opposite longitudinal ends of a main body of the process cartridge. More preferably, the mounting frame is a wire frame. Preferably, one side of the filter is connected to the main body of the process cartridge and the other side is connected to the mounting frame, such that moving the frame toward the photosensitive member extends the filter over the photosensitive member and moving the frame away from the photosensitive member retracts the filter from the photosensitive member.

Throughout this document, unless otherwise indicated to the contrary, the terms "comprising", "consisting of", and the like, are to be construed as non-exhaustive, or in other words, as meaning "including, but not limited to".

BRIEF DESCRIPTION OF THE DRAWINGS

The invention will now be described, by way of example only, with reference to the accompanying drawings, in which.

PREFERRED EMBODIMENTS OF THE INVENTION

Figure 1:
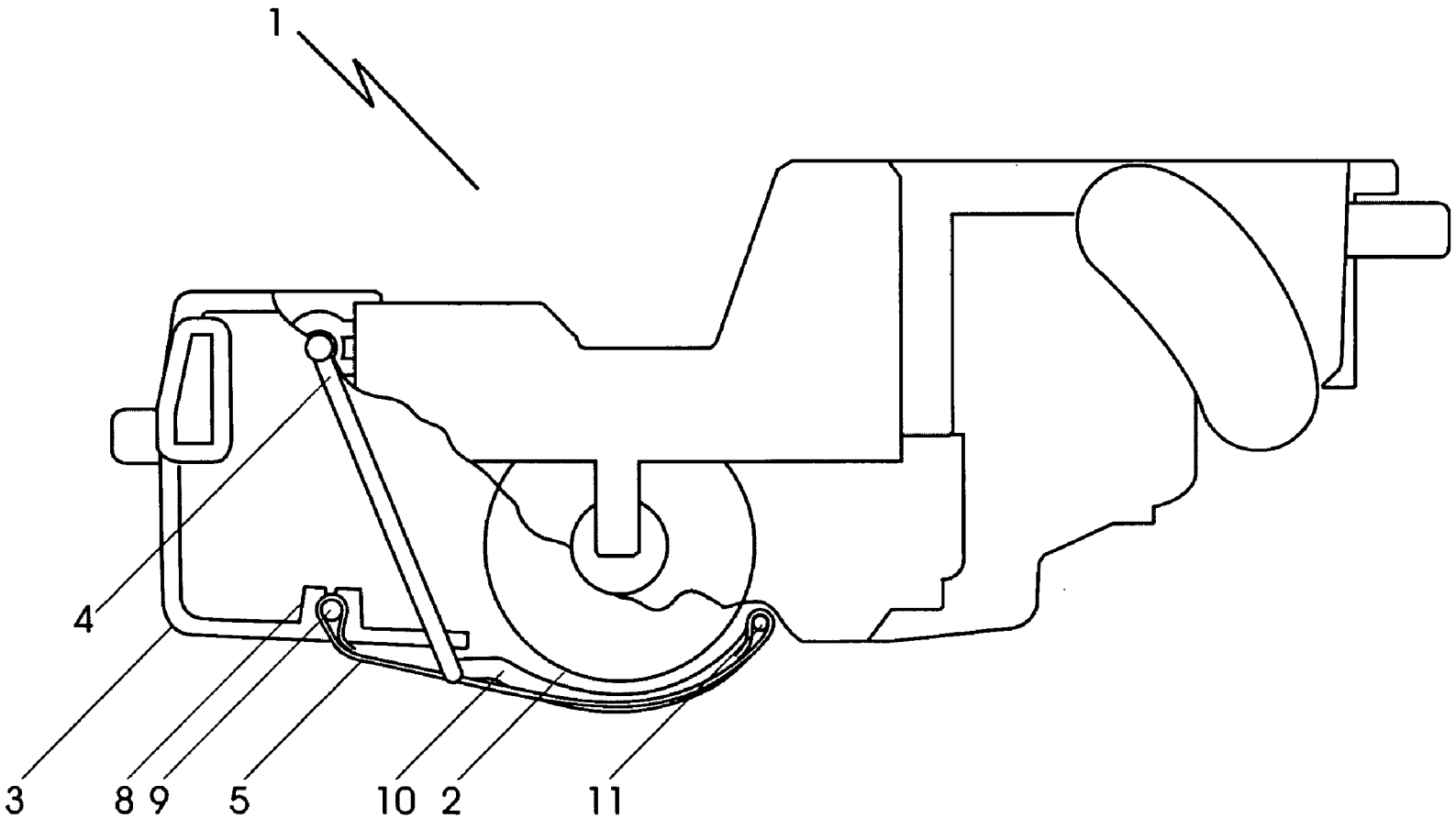
FIG. 1 is a cut-away elevation of the cartridge showing the basic construction of a fabric drum cover according to the invention.

Referring to the drawings, a toner cartridge 1, as well known in the art, contains certain process elements, one of which is the photosensitive drum 2. The photosensitive drum typically has several surface layers which together enable the drum to carry a static charge for a period of time. However, if selected elements of the surface are exposed to light then those elements become conductive and the static charge is conducted away. It can be readily understood, therefore, that the surface of the photosensitive drum is sensitive not only to light but also to any kind of damage or contamination.

Most of the surface of a photosensitive drum 2 can be protected by the body 3 of the cartridge. However, in most commercial toner cartridges two areas through which the drum surface passes as it rotates have to be accessible by other elements of the host machine. These areas are the image exposure station, usually at the crest of the drum's rotation where the drum is exposed to information light; and the transfer station, where toner transfers from the drum surface to paper sheets passing below the drum. Hence, the transfer station is usually at the lower area of the drum's rotation. These two areas often have covers to prevent access to the photosensitive drum while the toner cartridge is not in use. The cover 4 which is the subject of this invention is that cover which protects the drum 2 during rotation through the transfer station.

The illustrated drum cover 4 covers and protects the photosensitive drum 2 when the cartridge is not engaged with the electrophotographic apparatus. In the majority of applications in the art, a rigid cover is employed which is made of an injection mouldable resin. A rigid cover such as this protects the drum from most impact damage and also from light and contamination. The illustrated fabric cover 4, however, does not have the rigidity to protect the drum from severe impact damage, but on the other hand, if the fabric cover is pressed against the surface of the photosensitive drum it will be less likely to damage the fragile drum surface than would a rigid cover. Due to its soft and flexible nature, it can also provide a cushioning effect against minor impacts or pressing actions which give it a significant advantage over rigid covers. Like a rigid cover, the fabric cover 4 will shield the photosensitive drum 2 from light, which decays the drum's surface, and also protects the drum from contamination. The most common contamination affecting photosensitive drums is touch by human hands which leaves oil on the surface which in turn can trap other contaminants as well as reduce the effectiveness of process elements that contact with the photosensitive drum, such as the cleaning blade and primary charge roller. Furthermore, if the oil transmitted by touch contains silicone as used in cosmetics and hand creams, the photosensitive surface can be caused to fracture.

The fabric cover 4 also serves to filter airborne particles from air which is caused to pass around or through the opened cover. The most common particles circulating in laser printers and copiers are toner particles which may range in size from 1 to 20 microns. Typically, it is the smaller particles which escape from the system and are borne away by circulating air. It is the intention of this invention that as many particles as possible are captured by the fabric.

The preferred embodiment of the invention utilises a drum cover including a filter 5 made up of two layers of the same fabric. The filter fabric used in the preferred embodiment is spun-bond polypropylene. The density of the material in the preferred embodiment is 45 grams per square metre for the outer (black) layer and 38 grams per square metre for the inner (white) layer. The outer filter layer has an air permeability of around 1470 mm/s and the inner filter layer preferably has an air permeability of around 970 mm/s. The equivalent opening size, O95, in both the outer and inner layer is preferably around 0.12 mm.

The measurements of air permeability and equivalent opening size referred to above are determined in accordance with Chinese standard Guobiao Tuijian GB/T5453-1997 and GB/T14799-1993.

Many other materials can also be used in the filter to provide varying degrees of filtration. One particularly preferred filter medium is High Efficiency Particulate Air Filter, or "HEPA", which has micron sized pores for capturing the very smallest airborne particles.

FIG. 1 shows the construction of the preferred embodiment with the cover in a closed position and protecting the photosensitive drum 2 from light and from touching by hand. The inner fabric layer 6 is closest to the photosensitive drum. In the preferred embodiment, the inner layer is white in colour to allow for ease of visual detection of the degree of contamination. Moreover, by inspecting the inner layer, a refiller can gauge whether the cover should be replaced based on the amount of contamination in the filter.

The outer fabric layer 7 in the preferred embodiment is black in colour to match the overall colour of the cartridge. The outer material, however, is of the same composition as the inner layer, and differs from the inner layer only in terms of colour and density.

One side of the cover is anchored into the body 3 of the toner cartridge by clips 8, integrally formed in the cartridge body. The outer fabric layers are looped around an anchor wire 9 which has a diameter larger than the mouth of the clips but smaller than the clip bay. Hence, the cover can be easily snap-locked to the body of the toner cartridge by pushing the wire 9 past the mouth of the clips and into the clip bay.

The other side of the cover is fastened to a swinging arm 10 in the form of a wire trapeze. Once again the outer fabric layer 7 is looped around to enclose the wire along a longitudinal portion 11 which runs the axial length of the photosensitive drum.

Figure 2:
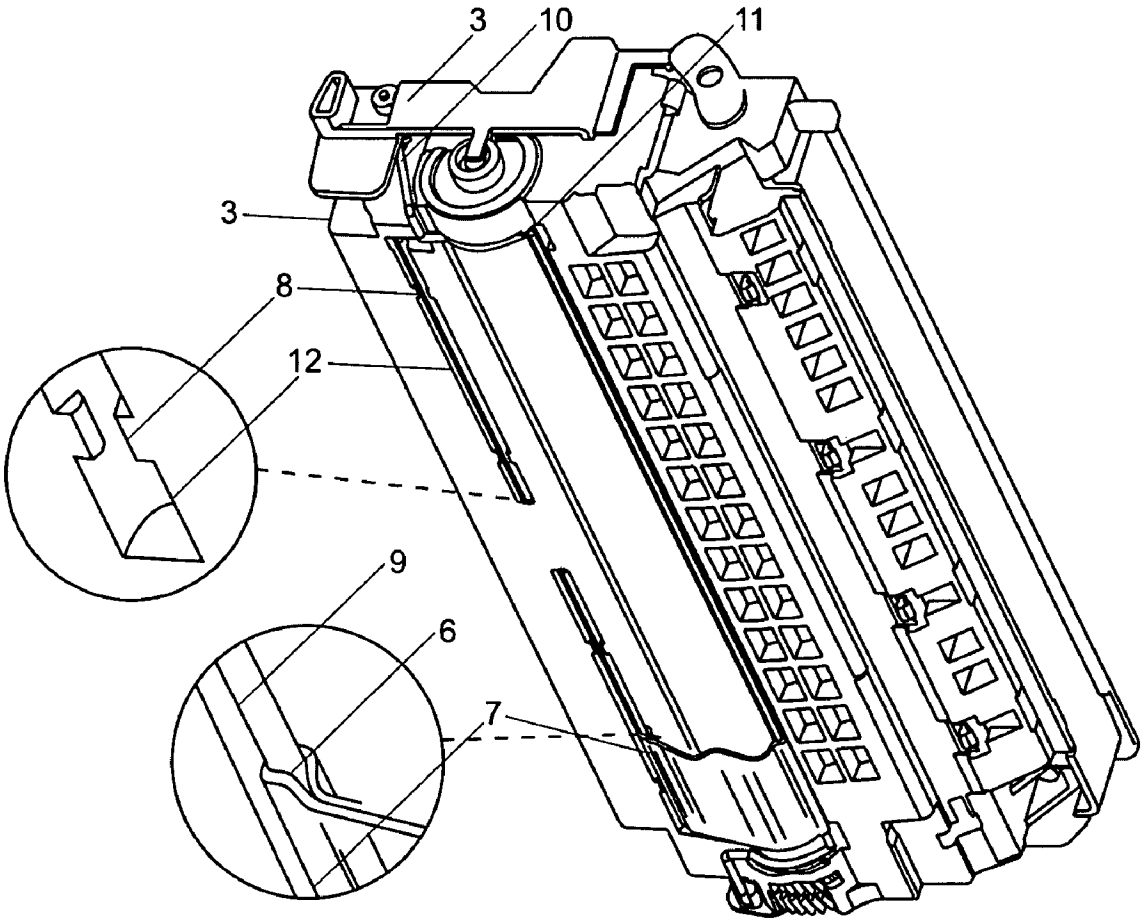
FIG. 2 is an underneath perspective of the cartridge of FIG. 1, showing fixing details of the fixed side of the drum cover.

FIG. 2 shows in detail the attachment portion where the cover is fixed to the cartridge body 3. Two slots 12 are moulded into the underside of the body 3 and each slot has two moulded clips 8 inset into it, making four clips in all. The anchor wires 9 are firstly secured to the fabric layers which loop around them. Then the wires are pressed into the slots 12 and secured firmly by the clips 8. This secures the respective side of the cover to the cartridge body.

Figure 3:
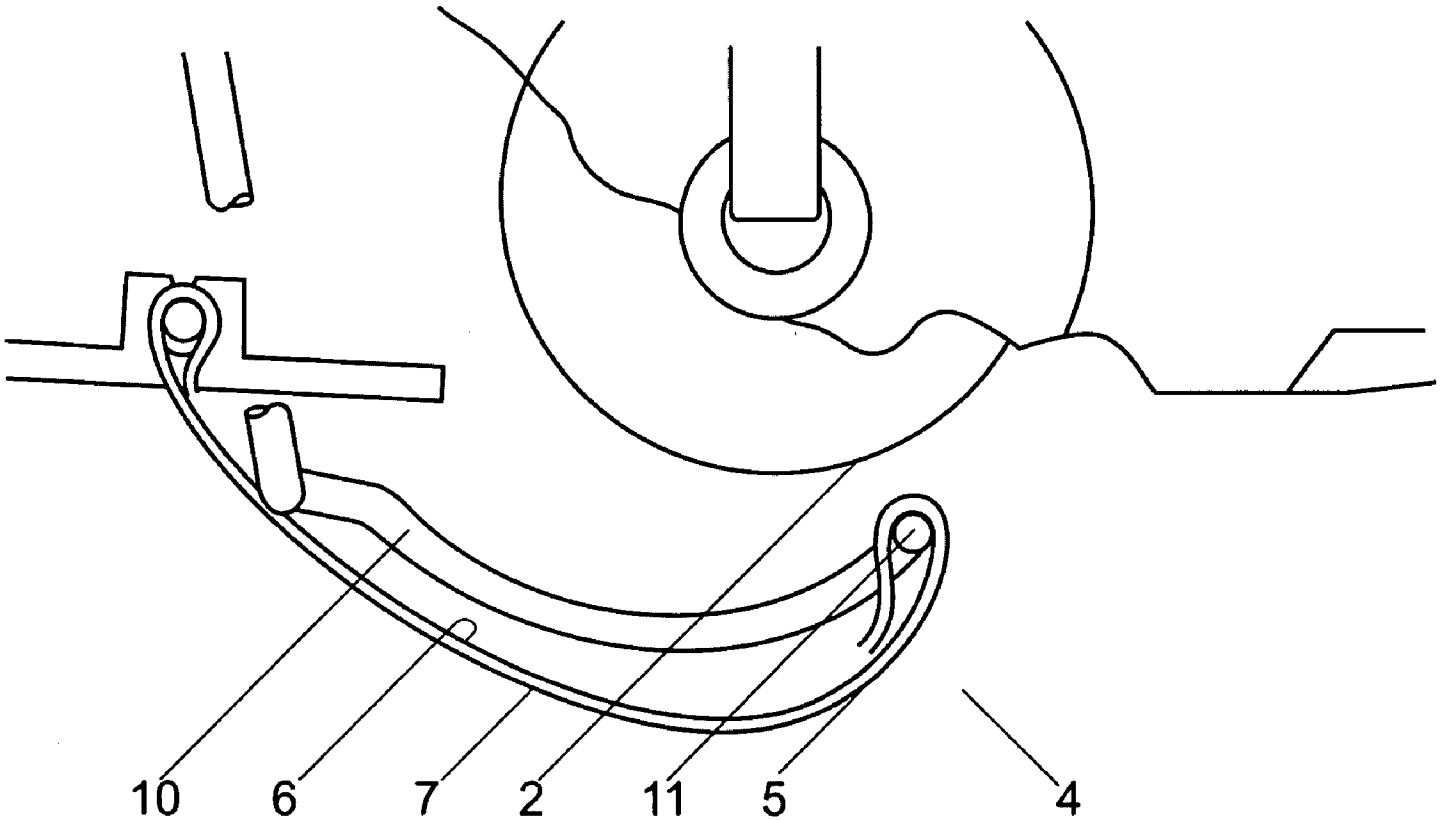
FIG. 3 is a detail of the attachment of the cover to the trapeze arm.

FIG. 3 shows in detail the attachment of the fabric cover 4 to the wire trapeze 10. The outer 7 and inner 6 layers of fabric are formed into a loop around the longitudinally extending portion 11 of the wire 10, which portion extends along the axial length of the photosensitive drum 2. The fabric is connected to the loop by adhesive or stitching in such a way that the loop is free to rotate around the wire 10 when the cover moves between a closed protective position and an open operative position.

Figure 4:
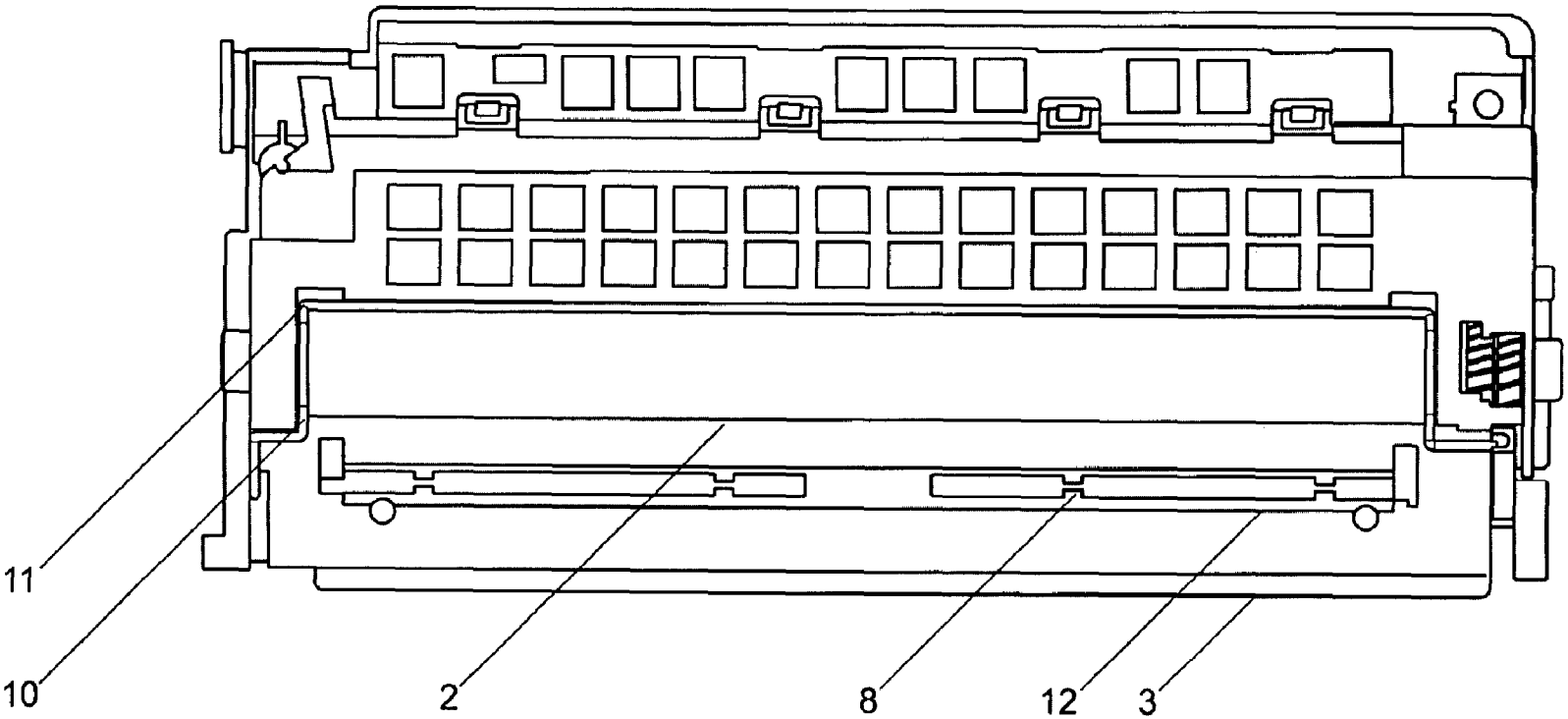
FIG. 4 is an underneath view of a toner cartridge prior to fitting the drum cover.

FIG. 4 is an underneath view of the cartridge with the filter 5 removed but showing four clips 8 as employed in the preferred embodiment. In FIG. 4, the swinging arm 10 is shown in the closed protective position, with longitudinal portion 11 again running the axial length of the drum.

Figure 5:
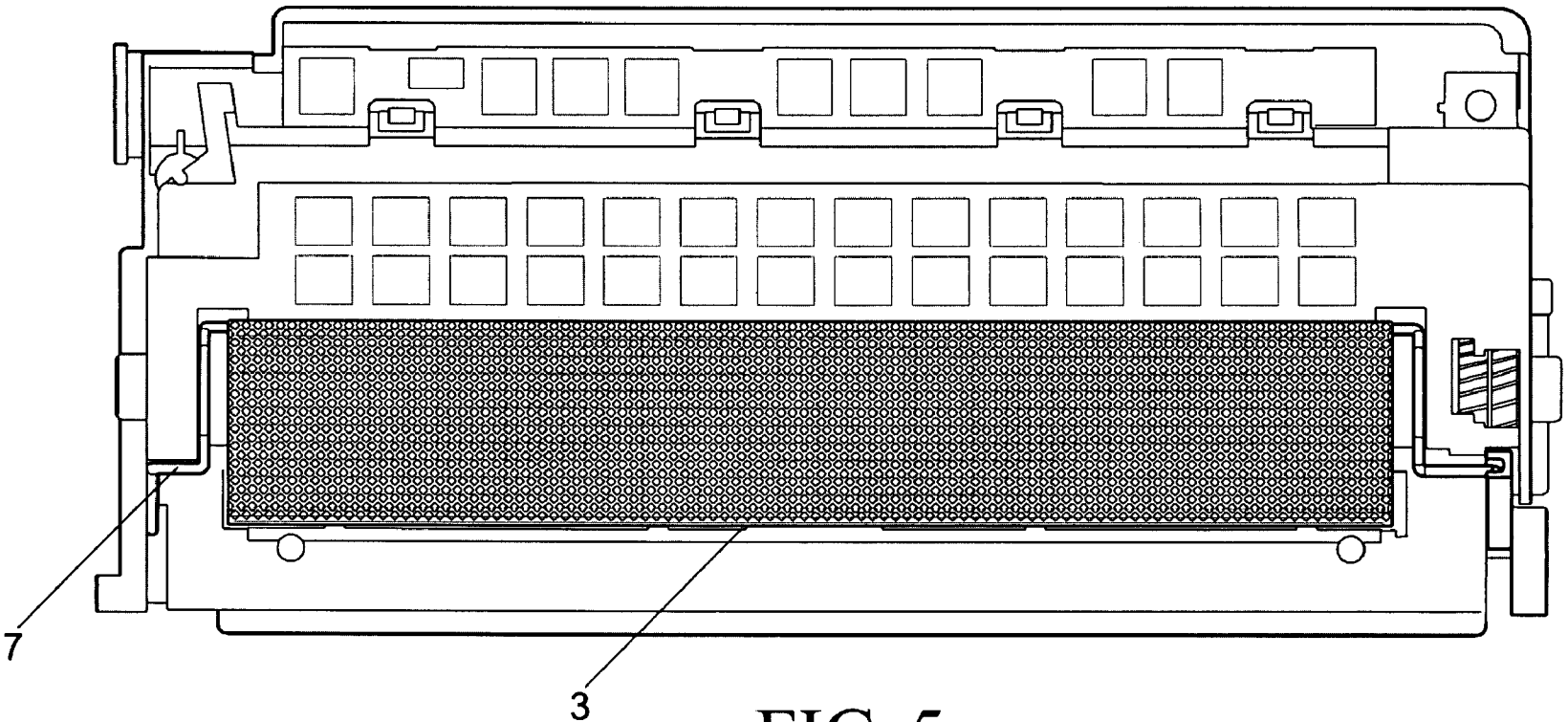
FIG. 5 is the same view as FIG. 4 but with the drum cover fitted.

FIG. 5 is the same view as FIG. 4, with the filter 5 shown. The outer filter fabric layer 7 is shown by shading.

Figure 6A:
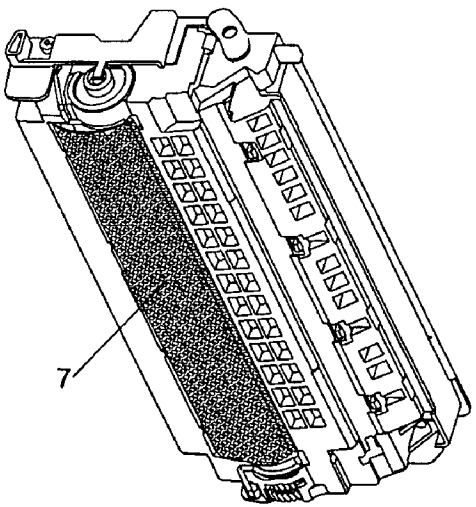
FIGS. 6A, 6C and 6E are underneath perspective views of the toner cartridge with the drum cover in the closed, semi-opened and fully opened positions respectively.
Figure 6C:
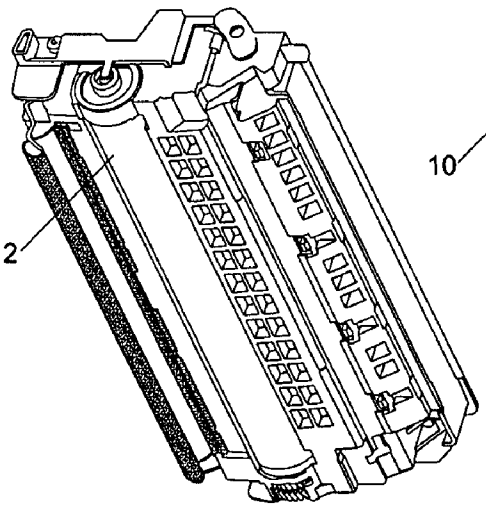
Figure 6E:
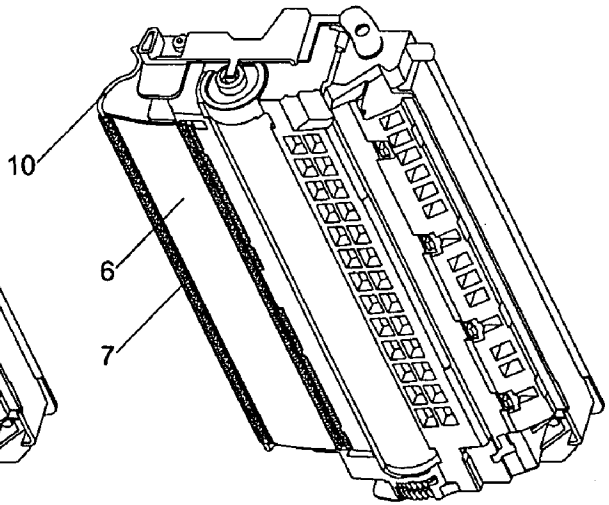
Figure 6B:
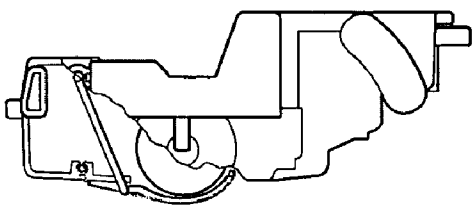
FIGS. 6B, 6D and 6F are cut-away elevations of the toner cartridge with the drum cover in the closed, semi-opened and fully opened positions respectively.
Figure 6D:
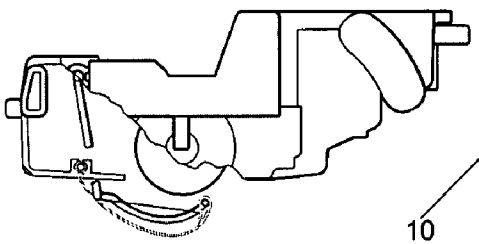
Figure 6F:
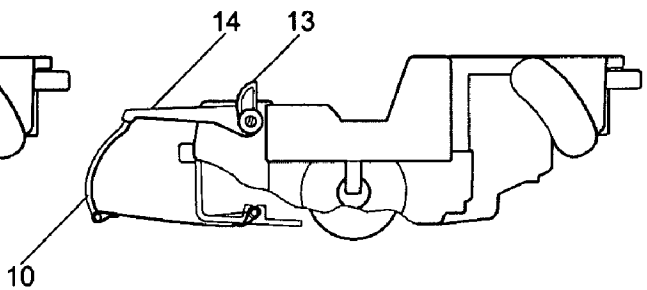

FIGS. 6A, 6C and 6E show the cover in a closed, semi-open and fully open position respectively. The cover is caused to open by an actuator (not shown) in the host machine acting on a cam portion 13 of a lever 14 that is fixedly connected to the wire trapeze 10 at one side of the toner cartridge. The cam portion 13 is actuated during the act of installation of the toner cartridge into the host machine and the cover is thus caused to open. This is also shown in sectional views 6B, 6D and 6F. The closing action is the reverse sequence and takes place when the cam 20 is withdrawn from the actuator and a torsion spring (not shown) returns the cam to its rest position whereby the cover is closed.

Figure 7:
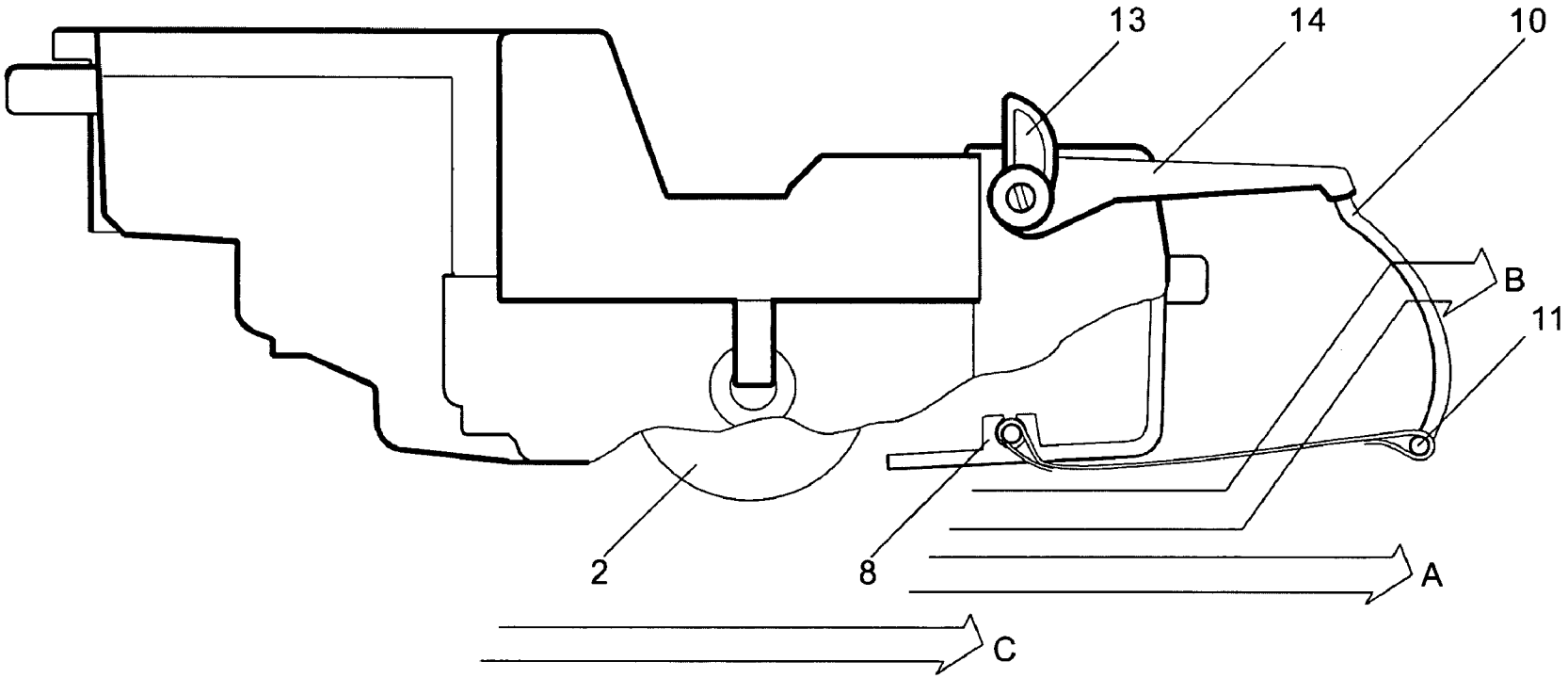
FIG. 7 is a cut-away elevation of the cartridge showing the air flow paths (A) and paper direction (C).

When the cover is in the open operative position, the photosensitive drum 2 is exposed for image transfer. In the open position, the cover 4 extends from the end fixed to the cartridge body in a direction away from the photosensitive drum 2, with the inner layer 6 being exposed and facing downwards, as shown in FIG. 6*e* and FIG. 7.

In the illustrated embodiment, the cover 4 opens in the paper-forward direction relative to the photosensitive drum 2. This direction is shown in FIG. 7 as arrow C. It can also be seen that the fixing clips 8 are forward of the photosensitive drum 2 in the paper forward direction C. However, other embodiments can include clips upstream of the photosensitive drum 2, with the cover 4 opening in an upstream direction.

Air flowing through the host machine whilst the machine is in operation is driven by a fan (not shown) to cool the working elements of the machine and evacuate not only the unwanted gases, such as ozone, generated by the photosensitive drum charging means, but also toner and other airborne particles. Contaminated air may be caused to flow along the inner layer 6 as shown by arrow A. Air might also be caused to pass through both layers of the filter 5, as shown by arrow B. In either case, any particles driven against the filter will have a chance of being trapped by the filter 5 and thus the air will be cleaned to at least some extent.

When the cartridge is extracted for clearing of paper jams, colour change or cartridge replacement, the cover 4 is released by the actuator (not shown) and caused to close, whereupon the fabric layer 6 is positioned face-down over the photosensitive drum 2. Any toner particles that have been trapped by the filter 5 are thus retained until the cover is cleaned or replaced by the recycler.

It will be appreciated that in other embodiments (not shown), the filter 5 may comprise a single layer of fabric. Also, in some embodiments, the drum cover can be of the conventional hard-cover type, with the addition of a filter adjacent either the inside or outside of the hard cover, or formed integrally with the hard cover itself.

In a further embodiment, the filter 5 can comprise two or more layers of fabric, where each layer has preselected micro-filtration properties. In some embodiments, one of the filter fabric layers may be substantially impermeable.

Furthermore, it will be appreciated that the invention is not limited to a driven airflow or an airflow in any particular direction, as the device is intended to act on whatever airborne particles are caused to pass over or through the filter 5.

It will be appreciated that while the invention has been described with reference to specific examples, it may also be embodied in many other forms.

What is claimed is:

1. A cover for a photosensitive member having an axial length, the photosensitive member further being contained in a housing having at least one opening extending so as to expose at least a portion of the axial length of the photosensitive drum, where the cover protects the photosensitive member at at least one opening; and the cover comprises a filter adapted to capture airborne particles from air flowing around or through the cover.

2. The cover according to claim 1, comprising a mounting frame engageable with opposite longitudinal ends of a main body of the housing.

3. The cover according to claim 2, wherein the mounting frame is formed from wire.

4. The cover according to claim 2, wherein one side of the filter is connected to the main body of the housing and the other side is connected to the mounting frame, such that moving the frame toward the photosensitive member extends the filter over the photosensitive member and moving the frame away from the photosensitive member retracts the filter from the photosensitive member.

5. The cover according to claim 1, wherein the filter is formed from spun-bond polypropylene.

6. The cover according to claim 1, wherein the filter is a High Efficiency Particulate Air Filter.

7. The cover according to claim 1, wherein the filter comprises pores having an equivalent opening size of less than around 0.2 mm.

8. The cover according to claim 1, wherein the filter comprises pores having an equivalent opening size of less than around 0.15 mm.

9. The cover according to claim 1, wherein the filter has micro-filtration properties which are preselected to target the airborne particles.

10. The cover according to claim 1, having an air permeability of between 500 mm/s and 2000 mm/s.

11. The cover according to claim 1, wherein the filter comprises an outer and an inner layer of fabric.

12. The cover according to claim 11, wherein the outer and inner layer are formed from the same kind of fabric.

13. The cover according to claim 11, wherein a density of the outer layer of fabric is greater than a density of the inner layer of fabric.

14. The cover according to claim 11, wherein a density of the outer layer of fabric is between 40 and 50 grams per square meter and a density of the inner layer of fabric is between 35 and 45 grams per square meter.

15. The cover according to claim 11, wherein pores in the inner and outer layer of fabric are of substantially the same size.

16. The cover according to claim 11, wherein the inner layer is formed from a white coloured fabric to allow for ease of visual detection of an amount of toner captured by the filter.

17. The cover according to claim 11, wherein an air permeability of the inner layer is greater than an air permeability of the outer layer.

18. The cover according to claim 11, wherein an air permeability of the inner layer is around 1.5 times an air permeability of the outer layer.

19. The cover according to claim 11, wherein an air permeability of the inner layer is between 1000 mm/s and 2000 mm/s.

20. The cover according to claim 11, wherein an air permeability of the inner layer is between 1400 mm/s and 1600 mm/s.

21. The cover according to claim 11, wherein an air permeability of the outer layer is between 500 mm/s and 1500 mm/s.

22. The cover according to claim 11, wherein an air permeability of the inner layer is between 900 mm/s and 1100 mm/s.

23. A process cartridge for an electrophotographic device, the process cartridge comprising;

a photosensitive member having an axial length, a cover for said photosensitive member, the photosensitive member further being contained in a housing having at least one opening extending so as to expose at least a portion of the axial length of the photosensitive drum, where the cover protects the photosensitive member at at least one opening; and the cover comprises a filter adapted to capture airborne particles from air flowing around or through the cover.

24. The cartridge according to claim 23, comprising a mounting frame engageable with opposite longitudinal ends of a main body of the process cartridge.

25. The cartridge according to claim 24, wherein the mounting frame is formed from wire.

26. The cartridge according to claim 24, wherein one side of the filter is connected to the main body of the process cartridge and the other side is connected to the mounting frame, such that moving the frame toward the photosensitive member extends the filter over the photosensitive member and moving the frame away from the photosensitive member retracts the filter from the photosensitive member.

27. The cartridge according to claim 23, wherein the filter is formed from spun-bond polypropylene.

28. The cartridge according to claim 23, wherein the filter is a High Efficiency Particulate Air Filter.

29. The cartridge according to claim 23, wherein the filter comprises pores having an equivalent opening size of less than around 0.2 mm.

30. The cartridge according to claim 23, wherein the filter comprises pores having an equivalent opening size of less than around 0.15 mm.

31. The cartridge according to claim 23, wherein the filter has micro-filtration properties which are preselected to target the airborne particles.

32. The cartridge according to claim 23, wherein the filter has an air permeability of between 500 mm/s and 2000 mm/s.

33. The cartridge according to claim 23, wherein the filter comprises an outer and an inner layer of fabric.

34. The cartridge according to claim 33, wherein the outer and inner layer are formed from the same kind of fabric.

35. The cartridge according to claim 33, wherein a density of the outer layer of fabric is greater than a density of the inner layer of fabric.

36. The cartridge according to claim 33, wherein a density of the outer layer of fabric is between 40 and 50 grams per square meter and a density of the inner layer of fabric is between 35 and 45 grams per square meter.

37. The cartridge according to claim 33, wherein pores in the inner and outer layer of fabric are of substantially the same size.

38. The cartridge according to claim 33, wherein the inner layer is formed from a white colored fabric to allow for ease of visual detection of an amount of toner captured by the filter.

39. The cartridge according to claim 33, wherein an air permeability of the inner layer is greater than an air permeability of the outer layer.

40. The cartridge according to claim 33, wherein an air permeability of the inner layer is around 1.5 times an air permeability of the outer layer.

41. The cartridge according to claim 33, wherein an air permeability of the inner layer is between 1000 mm/s and 2000 mm/s.

42. The cartridge according to claim 33, wherein an air permeability of the inner layer is between 1400 mm/s and 1600 mm/s.

43. The cartridge according to claim 33, wherein an air permeability of the outer layer is between 500 mm/s and 1500 mm/s.

44. The cartridge according to claim 33, wherein an air permeability of the inner layer is between 900 mm/s and 1100 mm/s.

* * * * *